United States Patent [19]

Fischer et al.

[11] 4,273,195

[45] Jun. 16, 1981

[54] FIRE PROTECTION SPRINKLER HEAD WITH AIR-CURRENT DIVERTING FINS

[75] Inventors: Michael A. Fischer, North Kingstwon, R.I.; Jerome S. Pepi, North Attleboro, Mass.

[73] Assignee: Grinnell Fire Protection Systems Company, Inc., Providence, R.I.

[21] Appl. No.: 34,636

[22] Filed: Apr. 30, 1979

[51] Int. Cl.[3] ..... A62C 37/12

[52] U.S. Cl. ..... 169/39; 169/42

[58] Field of Search ..... 169/37–42, 169/57, 90

[56] References Cited

U.S. PATENT DOCUMENTS

| | | | |
|---|---|---|---|
| 621,495 | 3/1899 | Iler | 169/39 |
| 1,244,106 | 10/1917 | Lewis | 169/42 |
| 1,248,433 | 11/1917 | Lewis | 169/42 |
| 1,300,046 | 4/1919 | Teague | 169/42 |
| 1,357,347 | 11/1920 | Roberts | 169/42 |
| 1,919,235 | 7/1933 | Loepsinger | 169/39 |
| 2,075,816 | 4/1937 | Loepsinger | 169/39 |

*Primary Examiner*—F. J. Bartuska
*Assistant Examiner*—Fred A. Silverberg

[57] ABSTRACT

A fire-protection sprinkler head with an improved response characteristic achieved by providing a fusible link with a fin having multiple face portions oriented to direct air currents from any of a plurality of orthogonal directions over the fusible region of the link. An embodiment with multiple fins provides an aggregate set of face portions that direct over the fusible region air currents that have X, Y, and Z orthogonal components in both positive and negative senses. Air currents can be directed both by deflecting effects and air foil effects. Preferably the face portions are facets formed integrally with sheet metal body members that form the link. In the preferred embodiment the link and all fins are formed of a pair of similar stampings from sheet metal.

12 Claims, 12 Drawing Figures

FIG 1
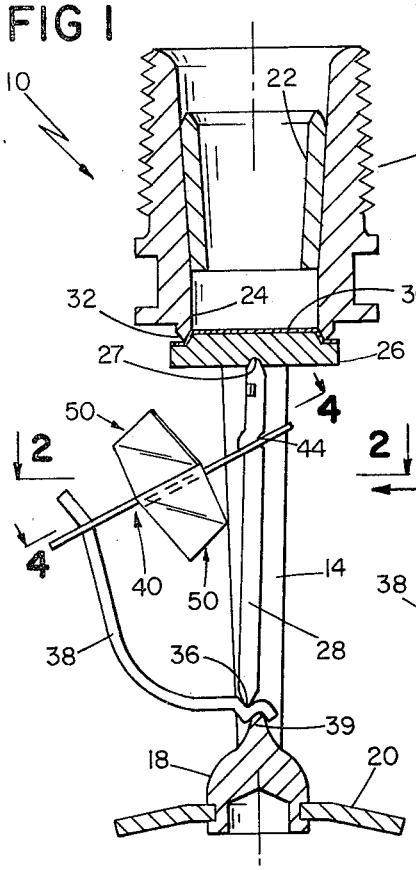
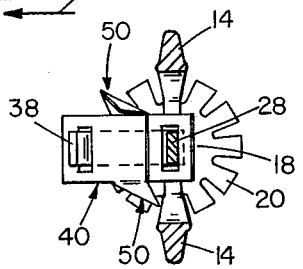
FIG 2
FIG 3
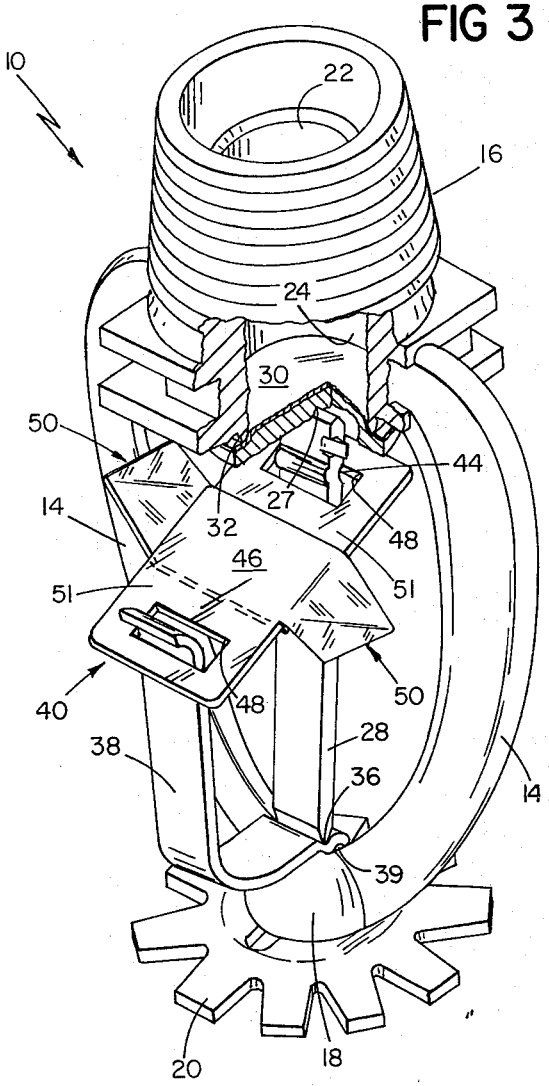
FIG 4
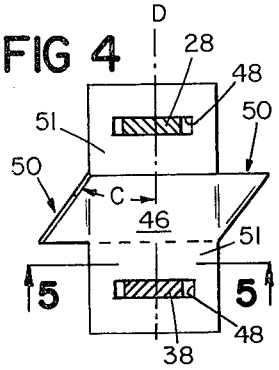
FIG 6
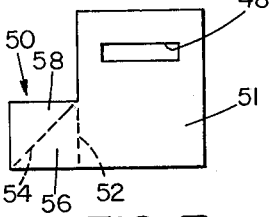
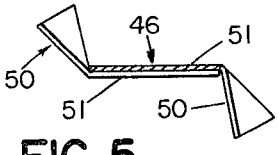
FIG 5
FIG 7
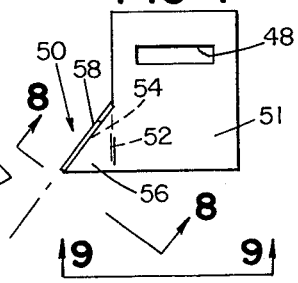
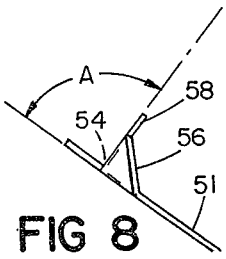
FIG 8
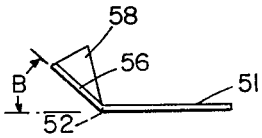
FIG 9
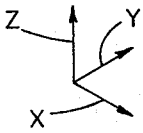
FIG 10
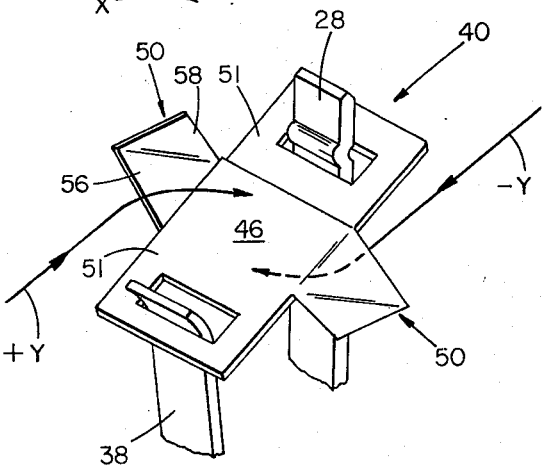

FIRE PROTECTION SPRINKLER HEAD WITH AIR-CURRENT DIVERTING FINS

FIELD OF THE INVENTION

This invention relates to automatic sprinkler heads for fire protection.

BACKGROUND OF THE INVENTION

Automatic sprinkler heads with temperature-responsive fusible elements have long been used in all types of buildings for fire protection. There is a need, however, for a sprinkler especially suited for residential use. In the past, residential sprinklers were of the type originally developed for factories and like applications. To serve in residential applications, a sprinkler valve should have a faster (e.g., a factor of four) response time than has been needed in many conventional applications, i.e., it must turn on sooner at a given air temperature. The faster response is needed to detect the presence of a fire soon enough to prevent buildup of noxious gases (e.g., carbon monoxide) from burning materials (e.g., plastics) commonly found in residences. The faster response is also desired to better contain and extinguish flames.

Government and industry organizations have conducted research on the required speed of response, which indicates that a 21 second or smaller time constant is necessary. The time constant is measured as the period of time required for the fusible element in the sprinkler to achieve 63% of the rise in temperature occasioned by inserting the sprinkler from ambient into a stream of heated air flowing through a duct. For example, were the sprinkler moved from equilibrium at 70° F. into a stream of 360° F. air, the time constant would be the amount of time required for the fusible element to reach 63% of the total rise in temperature, or 63% of 290° F. The time constant is not, of course, necessarily the amount of time required to turn on the sprinkler in a fire, but rather an indication of the relative speed of response.

To obtain a fast response, prior sprinkler heads (e.g., Russell U.S. Pat. No. 1,834,319, Loepsinger U.S. Pat. No. 1,919,235, and Russell U.S. Pat. No. 1,932,805) have employed sheet-metal linkage members in contact with a fusible medium to reduce the thermal mass to be heated, and have added fins and flanges to the linkage members to conduct heat toward the fusible element. Russell U.S. Pat. No. 1,932,805 also teaches that flanges extending along the curved edges of one of the sheet-metal pieces can direct rising currents of warm air against the soldered surfaces between the flanges. Other efforts in the field are Teague U.S. Pat. No. 1,300,046, Loepsinger et al. U.S. Pat. No. 2,075,816, and Gloeckler U.S. Pat. No. 3,874,456.

SUMMARY OF THE INVENTION

It has been found that faster sprinkler response times, low enough to meet the above-mentioned 21 second test, can be achieved by providing a fusible link with a fin having multiple face portions oriented in different directions to divert air currents from any of a plurality of orthogonal directions over the fusible region of the link.

In preferred embodiments, a plurality of fins each with multiple face portions serve to divert mutually orthogonal X, Y, and Z air current components over the fusible region, e.g., two of the components being horizontal and the other vertical; two of the fins are on opposite transverse sides of the link; the two fins are each an integral extension of one member; the fusible region is planar and one of the two fins extends above the planar region and the other of the two fins extends below the planar region, whereby air diverted over the fusible region by one fin is not retarded in moving away from the link by the second fin and thus heat transfer is enhanced by a continuous movement of air across the fusible region; a first face portion (e.g., outboard) is positioned and inclined with respect to the X air current components and a second face portion (e.g., inboard of the outboard portion) is positioned and inclined with respect to the Z air current components; the inclination of the second face portion also has an air-foil effect (e.g., from a convex surface) and diverts Y air current components tending to pass below the planar fusible region to a course passing over the upper surface of the region and Y components tending to pass above the region to a course passing over the lower surface of the region; the face portions are planar facets connected by bend regions; the axis of curvature of the outboard bend region is skewed with respect to the axis of the inboard bend region; the outboard facets are substantially perpendicular to the planar fusible region and the normals of the outboard facets are inclined at about 45 degrees to the Y air currents and to the direction of elongation of the link; the inboard facet forms a concave surface on the other side to provide the air-foil to divert the Y components; the fin mass constitutes less than 20% of the total mass of the link; the sprinkler head further includes a generally vertical strut engaging a plug member that seals the passage through which fire-retardant fluid flows, the strut shadowing the link from some of the air currents while one or more fins lie out of the shadow to intercept the air currents; the sheet metal members forming the two halves of the link are rectangular and overlap each other longitudinally from 20 to 80 percent of the area of each member; the fins are square before bending and the second bend runs along a diagonal of the square to form two equal-area triangular facets that form the face portions; and the link weighs 0.8 gram and has a time constant of 21 seconds.

PREFERRED EMBODIMENT

The structure and operation of a preferred embodiment of the invention will now be described, after first briefly describing the drawings.

DRAWINGS

FIG. 1 is a vertical, partially cross-sectional, view of said embodiment.

FIG. 2 is a horizontal cross-sectional view at 2—2 of FIG. 1.

FIG. 3 is a perspective view of said embodiment.

FIG. 4 is a view at 4—4 of FIG. 1, showing the fusible link.

FIG. 5 is a cross-sectional view at 5—5 of FIG. 4.

FIG. 6 is a view of one portion of the fusible link before bending the fin element, showing fold lines for the element.

FIG. 7 is the same view as FIG. 5 with the fin element bent along its two fold lines.

FIG. 8 is a projection taken at 8—8 of FIG. 7, showing that one surface of the fin element is substantially at a right angle with respect to the surface of the fusible link.

FIG. 9 is a projection taken at 9—9 of FIG. 7.

Figure 12:
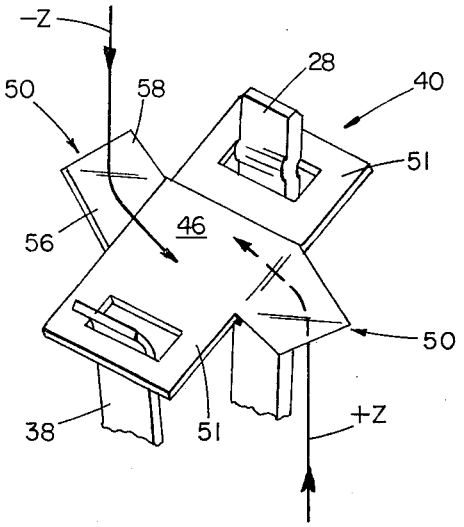
Figure 11:
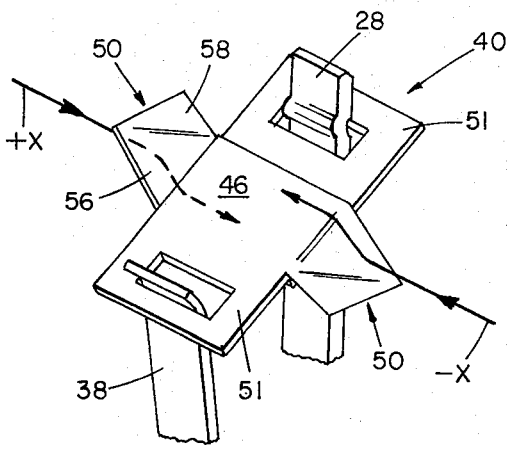

FIGS. 10, 11, and 12 are perspective views of the fusible link, illustrating the diversion of X, Y and Z air current components onto the fusible region of the link by the fins.

STRUCTURE

Turning to FIGS. 1-3, there is shown automatic fire sprinkler head 10. The sprinkler consists of a valve body with curved arms 14 extending down from a threaded end 16 to an apex 18, at which a spray deflector 20 is attached. Threaded end 16 is screwed into a fitting in the piping system of a pressurized water (or other fire-retardant fluid) supply system. Bushing 22 fits within passage 24, and reduces the orifice size to enhance the spray pattern.

Sealing the outlet of passage 24 is button 26 held in place by strut 28 (silicon bronze, ASTM B97, Alloy 655). Gasket 30 (soft, annealed copper) is deformed between button 26 and sharp edge 32 extending around the outlet of passage 24.

Strut 28 extends between an abutment groove 27 on the underside of button 26 and another groove 36 in a resilient lever 38. Groove 36 is slightly offset from the vertical centerline of passage 24. The lever 38 pivots on ridge 39 which is positioned at the centerline of the passage. Lever 38 is held in place by fusible link 40 extending between the top end of the lever and groove 44 in strut 28.

Fusible link 40 consists of two halves 51 (mirror images of each other) made of copper sheet metal (about 11 mils thick; 0.48 inches wide; 0.575 inches long) laminated with solder (1 to 4 mils thick) in a lap joint (0.25 inch overlap between halves) at fusible region 46 of the link. Each half 51 of the link has an aperture 48 and a fin element 50.

Referring to FIGS. 6-9, each fin element is cut as a square tab (0.25 by 0.25 inches) extending laterally from one side of each piece 51 of the link. The element is then formed by bending along two bend lines 52, 54 to form equal area inner and outer fin facets 56, 58, respectively. As can be seen in the projection of FIG. 8, outer facet 58 makes a right angle A (88 to 90 degrees) with the main surface of the fusible link. Inner facet 56 is oriented at an angle B of between 43 and 47 degrees with the main surface of the fusible link. The combined effect of the two bends is to orient outer facet 58 so that it is at an acute angle C relative to the longitudinal direction D (longitudinal plane of symmetry) of the fusible link. The whole fusible link has a mass of about 0.8 grams.

OPERATION

Sprinkler head 10 is installed either as shown with the passage centerline vertical or rotated 90° to make the centerline horizontal.

Under normal conditions, in the absence of fire, fusible link 40 can provide sufficient restraining force (about 10 lb) on lever 38 to maintain the seal of gasket 30 against valve seat 32. A large mechanical advantage is provided by the small offset of strut 28 from the fulcrum formed by ridge 39. Fusible link 40 is spaced a much greater distance from the fulcrum than the strut, such that a 10 lb force from link 40 produces a substantially greater upward force (about 200 lb) on button 26.

When link 40 is heated sufficiently to cause the solder laminating its two halves 51 to approach melting temperature (about 136.5° F.) and thereby lose its strength, the two halves, being under tension, separate. This allows lever 38 to rotate downward and away from the passage centerline, thereby removing the force on strut 28, button 26, and gasket 30. The various parts are blown away by water exiting from the outlet of passage 24. Fluid strikes deflector plate 20, producing a fine spray which is distributed over a wide area. The spray pattern depends on the configuration of the deflector plate and on the flow rate from passage 24. The flow rate is adjustable by changing the internal area of bushing 22.

The key to the fast response of the sprinkler regardless of the location of the fire is the provision of fin facets 50 for diverting the warm air currents generated by the fire onto the fusible region. Without the facets, these air currents would pass by the link without transferring heat.

The air currents can be resolved into components in the X, Y, and Z directions shown by the axes of FIG. 10. The axes are referenced to the sprinkler body with the Z axis parallel to the centerline of passage 24. As shown, with the centerline vertical, the X and Y directions are horizontal, and the Z direction is vertical. If the sprinkler were installed horizontally, either the X and Z or the Y and Z directions would instead be horizontal, depending upon the chosen rotational orientation of the sprinkler head.

When a fire occurs off to the side of the sprinkler head, the predominant air currents are horizontal, and thus are along the X and Y directions when the sprinkler head is installed as shown. If the sprinkler is installed horizontally, the predominant air currents would be along the X and Y or X and Z directions.

FIGS. 10, 11, and 12 illustrate how air currents of each of the X, Y, and Z directions are diverted onto the fusible region 46. Air currents in the +Y or −Y directions (i.e. in either a positive or negative sense along the coordinate) are diverted by outer facets 58 which are inclined at an acute angle C with respect to the Y direction. Air currents in the +Z and −Z directions are diverted along the concave surface formed by inner facet 56 which is set at an angle B with respect to the plane of the link. Air currents in the +X and −X directions are diverted by an air-foil effect along the convex surface formed by the opposite side of facet 56. In the instance when the air currents are not resolved exactly along either direction, the air diversion will be a combination of the effects illustrated.

Other embodiments are within the scope of the following claims. For example, the fusible link 40 could be nonplanar (e.g., semicylindrical) and it could have various positions with respect to the passage centerline, under either tension or compression load. In this embodiment and others in which the link is not substantially horizontal, the axes for resolving air currents should be referenced to the link itself in order to be consistent with the above explanation of air diversion. The X and Y directions would be parallel to the link and the Z direction normal to the link. In the preferred embodiment, the link is only slightly inclined from the horizontal, and thus there is little difference between the two sets of axes.

What is claimed is:

1. In a fire-protection sprinkler head with a fusible link, a passage in the head through which fire-retardant fluid can flow, and a closure for said passage, said link including two sheet-metal members joined at a fusible region by a fusible medium, each said member being engaged with another portion of said sprinkler head and said link being under load in its longitudinal direction and in a manner to hold said closure in position to close said passage, said members being adapted to release said load upon melting of said fusible medium to thereby release said closure to open said passage and allow flow of said fluid, the improvement wherein said fusible link includes at least two sheet-metal fins each of which has first and second face portions oriented in different directions to enable said fins to divert air currents from a plurality of orthogonal directions over said fusible region, said fusible region is generally planar and has two opposite generally longitudinally extending edges, said fins extend from said edges, any said fin extending from the first of said edges extends away from said link in such a direction that said fin lies on one side of the plane passing through said planar region, any said fin extending from the second of said edges extends away from said link in such a direction that said fin lies on the other side of said plane passing through said planar region, whereby air diverted over said fusible region by the fin extending from said first edge is not retarded in moving away from said link by the fin extending from said second edge and thus heat transfer is enhanced by a continuous movement of air across said fusible region.

2. In a fire-protection sprinkler head with a fusible link, a passage in the head through which fire-retardant fluid can flow, and a closure for said passage, said link including two members joined at a fusible region by a fusible medium, each said member being engaged with another portion of said sprinkler head and said link being under load in a manner to hold said closure in position to close said passage, said members being adapted to release said load upon melting of said fusible medium to thereby release said closure to open said passage and allow flow of said fluid, the improvement wherein said first face portions being formed by outboard portions of said fins and said second face portions being formed by inboard portions of said fins, and said first face portion being an outboard, planar facet and said second face portion being an inboard, planar facet and said inboard facet being connected to said outboard facet and the body of said member by inboard and outboard bend regions.

3. The sprinkler head of claim 2 wherein said inboard facet of each said fin is inclined at an obtuse angle with respect to said fusible region and said inboard facet, inboard bend region, and fusible region form a concave surface along which said Z air currents are diverted.

4. The sprinkler head of claim 3 wherein said outboard facet of each said fin is inclined at an obtuse angle with respect to said inboard facet and the axis of curvature of said outboard bend region is skewed with respect to the axis of said inboard bend region.

5. The sprinkler head of claim 4 wherein said outboard facets are substantially perpendicular to said planar fusible region and the normals of said outboard facets are inclined at about 45 degrees to the longitudinal plane of symmetry of said link, whereby said outboard facets are inclined to said Y air currents.

6. The sprinkler head of claim 3 wherein said inboard facet, inboard bend region, and fusible region form a convex surface, on the side opposite said concave surface, along which said Y air currents are diverted by said air-foil effect onto said fusible region.

7. In a fire-protection sprinkler head with a fusible link, a passage in the head through which fire-retardant fluid can flow, and a closure for said passage, said link including two sheet-metal members joined at a fusible region by a fusible medium, each said member being engaged with another portion of said sprinkler head and said link being under load in a manner to hold said closure in position to close said passage, said members being adapted to release said load upon melting of said fusible medium to thereby release said closure to open said passage and allow flow of said fluid, the improvement wherein said fusible link includes at least one sheet-metal fin having multiple face portions with different face portions oriented in different directions to enable said fin to divert air currents from a plurality of orthogonal directions over said fusible region, and said head further comprises a body having said passage, a strut generally axial to the passage engaging a plug member that forms said closure means and seals said passage through which fire-retardant fluid flows, a fulcrum member near the other end of said vertical strut and supported by a pair of arms extending from said body, a lever member acting as a lever between said fulcrum member and said vertical strut, said link extending between said lever member and said strut to supply a holding force to the lever to force said strut against said plug member, said sheet-metal members are rectangular and overlap each other longitudinally from 20 to 80 percent of the area of each member, said fusible layer extends over the region of overlap, one said fin is an integral extension of one of said sheet-metal members and another fin is an integral extension of the other of said members, and said face portions are planar facets formed by two bend regions on each fin, one bend parallel to the longitudinal axis of said link and located at the boundary between each said fin and member, and the other bend being spaced outward and skewed from the first bend.

8. The sprinkler head of claim 7 wherein said fins are square before bending and said second bend runs along a diagonal of the square to form two equal-area triangular facets that form said face portions.

9. The sprinkler head of claim 7 wherein said link weighs less than 1.0 gram and has a time constant of less than 25 seconds.

10. The sprinkler head of claim 9 wherein said link weighs about 0.8 grams and has a time constant of less than or equal to 21 seconds.

11. The sprinkler of claim 7 wherein said outer facet is about at right angles to the plane of said link.

12. The sprinkler of claim 11 wherein said inner facet is about at 45 degrees to the plane of said link.

* * * * *

UNITED STATES PATENT OFFICE

CERTIFICATE OF CORRECTION

Patent No. 4,273,195 Dated June 16, 1981

Inventor(s) MICHAEL A. FISCHER, ET AL.

It is certified that error appears in the above-identified patent and that said Letters Patent are hereby corrected as shown below:

Page 1, Column 1, application number "34,636" should be --34,686--.

Claim 2, Column 5, line 40, after "wherein" insert --said fusible link includes two fins each with multiple face portions, the aggregate set of face portions being relatively oriented and sufficient in number to divert X, Y, and Z air current components over said fusible region, one of said air current components being parallel to a first horizontal direction in the three-dimensional space surrounding said sprinkler head, another said component being parallel to a second horizontal direction perpendicular to said

CERTIFICATE OF CORRECTION

Patent No. 4,273,195 Dated June 16, 1981

Inventor(s) MICHAEL A. FISCHER, ET AL.

It is certified that error appears in the above-identified patent and that said Letters Patent are hereby corrected as shown below:

first, and the third component being parallel to the vertical direction in said space, said two fins being on opposite transverse sides of said link, said first face portion being positioned and inclined with respect to said X air current components to divert them from a course passing by said fusible region to a course passing over said region and said second face portion being positioned and inclined with respect to said Z air current components to divert them from a course passing by said fusible region to a course passing over said region,

UNITED STATES PATENT OFFICE

CERTIFICATE OF CORRECTION

Patent No. 4,273,195 Dated June 16, 1981

Inventor(s) MICHAEL A. FISCHER, ET AL.

It is certified that error appears in the above-identified patent and that said Letters Patent are hereby corrected as shown below:

the inclination of said second face portion also having an air-foil effect and diverting Y air current components tending to pass below said fusible region to a course passing over the upper surface of said region and Y air current components tending to pass above said region to a course passing over the lower surface of said region, --

Signed and Sealed this

First Day of February 1983

[SEAL]

Attest:

GERALD J. MOSSINGHOFF

Attesting Officer

Commissioner of Patents and Trademarks